US009301067B2

(12) United States Patent
Møller et al.

(10) Patent No.: US 9,301,067 B2
(45) Date of Patent: Mar. 29, 2016

(54) MINIATURE SPEAKER AND SPEAKER CABINET AND HEARING AID

(71) Applicant: Oticon, Smørum (DK)

(72) Inventors: Kenneth Rueskov Møller, Smørum (DK); Lars Steen Christensen, Smørum (DK)

(73) Assignee: OTICON A/S, Smorum (DK)

( * ) Notice: Subject to any disclaimer, the term of this patent is extended or adjusted under 35 U.S.C. 154(b) by 175 days.

(21) Appl. No.: 14/043,598

(22) Filed: Oct. 1, 2013

(65) Prior Publication Data

US 2014/0105437 A1 Apr. 17, 2014

Related U.S. Application Data

(60) Provisional application No. 61/712,824, filed on Oct. 12, 2012.

(30) Foreign Application Priority Data

Oct. 12, 2012 (EP) ..... 12188303

(51) Int. Cl.
*H04R 25/00* (2006.01)
*H04R 1/02* (2006.01)
*H04R 1/28* (2006.01)

(52) U.S. Cl.
CPC ..... *H04R 25/658* (2013.01); *H04R 1/025* (2013.01); *H04R 25/604* (2013.01); *H04R 25/65* (2013.01); *H04R 1/02* (2013.01); *H04R 1/28* (2013.01); *H04R 1/2803* (2013.01); *H04R 1/288* (2013.01); *H04R 1/2876* (2013.01); *H04R 1/2884* (2013.01); *H04R 1/2888* (2013.01); *H04R 2201/029* (2013.01)

(58) Field of Classification Search
CPC ..... H04R 25/02; H04R 25/04; H04R 25/60; H04R 25/604; H04R 25/652; H04R 25/656; H04R 25/658; H04R 2201/021; H04R 25/65; H04R 1/025; H04R 2201/029; H04R 1/28; H04R 1/288; H04R 1/2876; H04R 1/2884; H04R 1/2888; H04R 1/2803; H04R 1/02; H04R 1/1016; H04R 1/033; H04R 1/1058; H04R 1/1033
USPC ..... 381/380, 322, 324, 23.1, 394
See application file for complete search history.

(56) References Cited

U.S. PATENT DOCUMENTS 4,729,451 A * 3/1988 Brander ..... H04R 25/604 181/130
4,854,415 A * 8/1989 Goschke ..... H04R 25/608 181/130

(Continued)

*Primary Examiner* — Davetta W Goins
*Assistant Examiner* — Oyesola C Ojo
(74) *Attorney, Agent, or Firm* — Birch, Stewart, Kolasch & Birch, LLP

(57) ABSTRACT

A miniature speaker and speaker cabinet are provided, wherein the speaker is enclosed in an oblong capsule with a sound output opening at one end and leads passing from a speaker coil inside the capsule to connection points externally on the capsule, and where the cabinet encloses the capsule and at one end thereof comprise a lead input opening with leads passing there through to the connection points on the capsule, and where the cabinet further comprise a sound exit opening opposite the lead input opening, which is in fluid communication with the sound output opening of the capsule, wherein the cabinet has an internal space surpassing external measures of the capsule in all directions defining a gap between the capsule and cabinet wherein the thus defined gap is filled out with a hardening silicone.

16 Claims, 4 Drawing Sheets

(56) References Cited

U.S. PATENT DOCUMENTS 5,887,070 A * 3/1999 Iseberg ..... H04R 1/1016 181/130
6,766,030 B1 * 7/2004 Chojar ..... H04R 25/604 181/137
7,088,839 B2 * 8/2006 Geschiere ..... H04R 25/604 381/324
2002/0025055 A1 * 2/2002 Stonikas ..... H04R 25/652 381/322
2008/0112584 A1 * 5/2008 Karamuk ..... H04R 25/456 381/324

* cited by examiner

MINIATURE SPEAKER AND SPEAKER CABINET AND HEARING AID

AREA OF THE INVENTION

This nonprovisional application claims the benefit of U.S. Provisional Application No. 61/712,824 filed on Oct. 12, 2012 and to patent application Ser. No. 12/188,303.7 filed in Europe, on Oct. 12, 2012. The entire contents of all of the above applications are hereby incorporated by reference.

The invention regards a miniature speaker and speaker cabinet and a hearing aid. Speakers used in portable devices such as hearing aids and headset or telephones may be protected against impact such that the device may fall a certain distance and hit the ground without the speaker coming to any harm.

BACKGROUND OF THE INVENTION

In hearing aids and other devices the impact or shock protection may be provided between the capsule in which the speaker mechanism is placed and a cabinet which is provided around the speaker capsule. In order to save space in the mentioned devices the gap between the speaker capsule and the interior wall of the speaker cabinet should be minimized, however it is also in this gap that a possible shock protection measure can best be applied. It is the object of the invention to provide an enhanced shock protection of speaker such as in a hearing aid or similar device.

SUMMARY OF THE INVENTION

A Miniature speaker and speaker cabinet is thus provided, wherein the gap between speaker capsule and the cabinet is filled with a hardening silicone, and further the cabinet has internal space, which surpasses the external measures of the capsule in all directions thereby defining a gap between the capsule and the cabinet. This gap is filled with a hardening silicone. This allows the gap to be minimized, and thus the size of the cabinet can be made smaller, while the silicone, will act to ensure a reasonable shock protection.

The invention also regards a hearing aid having a casing part comprising audio signal input means such as microphone or an antenna, a battery, a signal processor and output contact points for serving an enhanced audio output signal, leads with a contact attachable to the output contact points at one end and at the other end thereof a miniature speaker and speaker cabinet. Such a hearing aid is known in the art, where the casing part is provided behind the ear, and the miniature speaker is inserted into the ear canal with the leads passing between the speaker and the casing, such that the audio signal from the speaker is provided in the ear canal of the user. The speaker is enclosed in an oblong capsule with a sound output opening at one end of the oblong capsule and has leads passing from a speaker coil inside the capsule to connection points externally on the capsule. The cabinet encloses the capsule and at one end of the capsule a lead input opening is provided with leads passing there through to the connection points on the capsule, and the cabinet further comprise a sound exit opening opposite the lead input opening, which is in fluid communication with the sound output opening of the capsule. The cabinet has an internal space surpassing external measures of the capsule in all directions and the thus defined gap is filled out with a hardening silicone. In this way, it is ensured, that the receiver inside the capsule will survive impacts from the cabinet falling to the floor from a table surface or from the hands of a user.

Such inadvertent impacts are bound to happen from time to time, and it is desired, that the hearing aid survives a reasonable number of such impacts without detrimental effects to the function thereof. Preferably the internal measures of the cabinet are no more than 10% larger than the outside measures of the capsule.

It is of importance that the speaker capsule is seated with equal spacing to all sides of the cabinet, and thus a number of different ways of securing a well centred position of the speaker capsule during production is suggested.

It is intended that the structural features of the hearing aid and miniature speaker described above, in the detailed description of 'mode(s) for carrying out the invention' and in the claims can be combined with the method for producing the hearing aid, when appropriately substituted by a corresponding process. Embodiments of the method have the same advantages as the corresponding hearing aid and miniature speaker.

Further objects of the invention are achieved by the embodiments defined in the dependent claims and in the detailed description of the invention.

As used herein, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that when an element is referred to as being "connected" or "coupled" to another element, it can be directly connected or coupled to the other element or intervening elements may be present, unless expressly stated otherwise. Furthermore, "connected" or "coupled" as used herein may include wirelessly connected or coupled. As used herein, the term "and/or" includes any and all combinations of one or more of the associated listed items. The steps of any method disclosed herein do not have to be performed in the exact order disclosed, unless expressly stated otherwise.

BRIEF DESCRIPTION OF THE DRAWINGS

The figures are schematic and simplified for clarity, and they just show details which are essential to the understanding of the invention, while other details are left out. Throughout, the same reference numerals are used for identical or corresponding parts.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DESCRIPTION OF A PREFERRED EMBODIMENT

Figure 1:
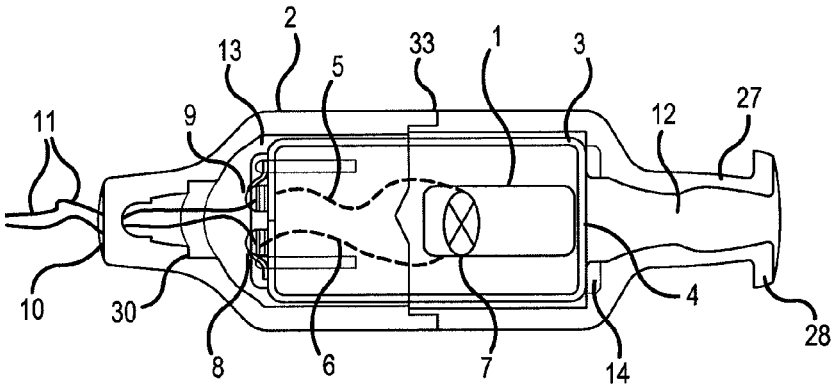
FIG. 1 is a sectional view of a miniature speaker.
Figure 2:
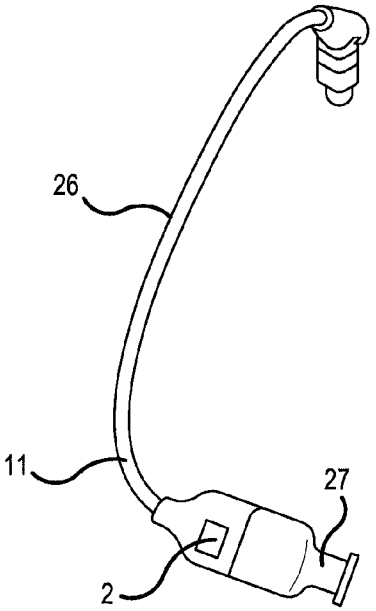
FIG. 2 is a picture of the speaker with leads and a contact point in the shape of a jack adapted to be plugged into a hearing aid casing part.

A miniature speaker 1 and speaker cabinet 2 are shown in FIG. 1. The speaker 1 is enclosed in an oblong capsule 3 with a sound output opening 4 at one end of the oblong capsule 3 and leads 5,6 passing from a speaker coil 7 inside the capsule 3 to connection points 8,9 externally on the capsule 3. As seen in the figure, the cabinet 2 encloses the capsule 3 and at one end of the cabinet 2 a lead input opening 10 with leads 11 passing there through to the connection points 8,9 on the capsule 3 are arranged. When the leads 11 are connected to an electrical audio output source, the electrical signals will reach the coil 7 and the speaker will provide an audio output in the form of sound waves by means of miniature components (not shown) namely a motor and a membrane connected to the motor as well known in speakers.

The cabinet 2 also comprise a sound exit opening 12 opposite the lead input opening 10, which is in fluid communication with the sound outlet opening 4 of the capsule. The cabinet 2 has an internal space surpassing external measures of the capsule 3 in all directions and the thus defined gap 13 is filled out with a hardening silicone. Various types of silicones may be used, however it is recommended, that a silicone, which shrinks during solidification is used, as this will leave air filled voids, and during impact a better survival rate of the speaker is obtained, possibly due to the fact that the voids, which are filled with air or gas are highly compressible such that the silicone may easily deform under impact and need not flow as far as in the case where the entire gap is full of silicone. Preferably a silicone with a shrinking factor of around 30% is used. Further, a silicone type, which does not solidify entirely, has also shown some very good shock protection abilities, most likely due to enhanced flow properties of this material. The silicone should be a very soft type, such as having a Shore A hardness of no more than 40.

The sound output opening 4 of the capsule 3 is surrounded by a gasket means 14 which forms a seal against an inside surface of the cabinet where said seal or gasket means surrounds the sound exit opening 4 of the cabinet 3. This measure ensures, that the silicon does not penetrate into the sound output opening 4 and possibly clog the mechanical parts of the speaker in the capsule 3, or flow into the sound exit opening 12 and thus prevent sounds from exiting the cabinet 2. This gasket means 14 may by any known type of gasketing or sealing, such as protrusions molded into the cabinet 2 or a soft o-ring provided on the receiver capsule similar well known means of sealing.

Figure 3:
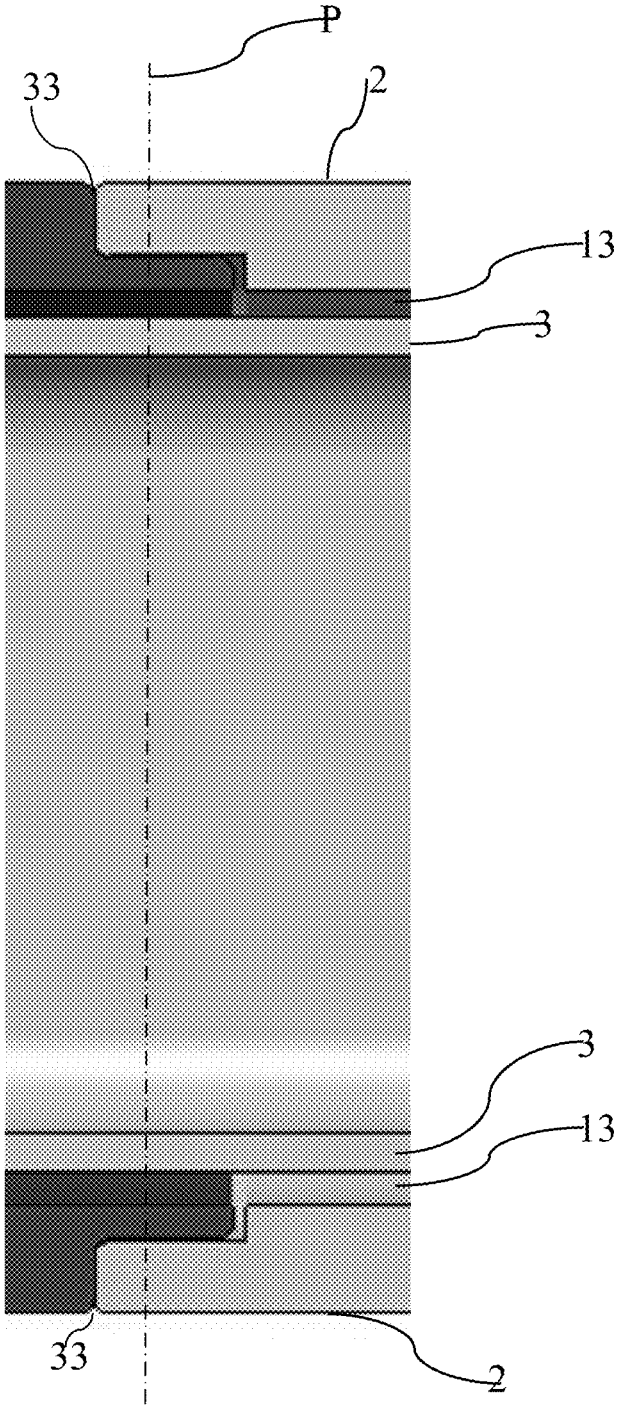
FIG. 3 shows is an enlarged sectional view of a part of the speaker cabinet and speaker capsule shown in FIG. 1.

As seen in FIG. 3 the speaker capsule 3 is centered inside the speaker cabinet 2, at least in a plane P defined by a normal parallel to a centre axis along the length of the oblong speaker capsule 3. By placing the capsule absolutely in the middle, it is ensured, that opposed gaps 13 will always be equal. This measure ensures that the gaps 13 are always at their maximum value and the best dampening is ensured. In the oblong direction of the speaker, the need for accuracy is not as pertinent, but never the less in this direction some measures must be taken to ensure, that the receiver capsule 3 is not at a foremost or rearmost position with respect to the cabinet 2.

One possible way to ensure even spacing between the outer walls of the capsule and the inner walls of the cabinet are to use soft pads fastened to surface parts of the speaker capsule. This may ensure even distance between internal walls of the cabinet and the external walls of the capsule.

Figure 4:
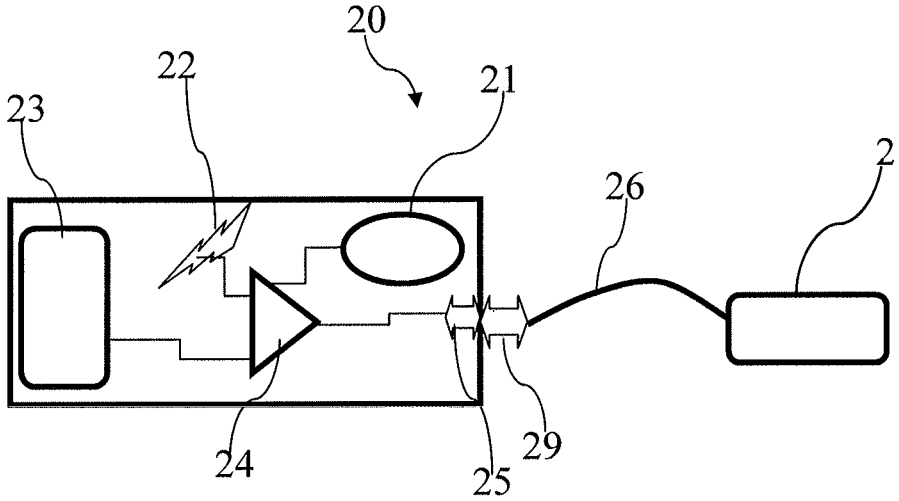
FIG. 4 is a schematic representation of a hearing aid.

FIG. 4 discloses in schematic form a hearing aid 20 having a casing part comprising audio signal input means such as a microphone 21 and/or an antenna 22, a battery 23, a signal processor 24 and output contact points 25 for serving an enhanced audio output signal. Leads 26 with a contact 29 attachable to the output contact points 25 at one end and at the other end thereof a miniature speaker and speaker cabinet 2 are also part of the hearing aid 20. The speaker and speaker cabinet comprise the element defined above and is only shown schematically in FIG. 4

As further seen in FIG. 1 the cabinet 2 encloses the speaker capsule 3 and comprises a snout 27 defining the sound exit opening 12 at a first end thereof. The snout 27 has at an outer end thereof a flange 28 surrounding the sound exit opening 12. Further the lead input opening 10 at an opposed end thereof comprise an internal recess 30 (also visible in FIG. 7D. The flange 28 allows for an easy attachment of a dome to the snout 27 such that the cabinet 2 may be fixated at a predetermined location inside an ear canal, and the gap between the snot 27 and ear canal may be sealed off in controlled manner. The recess 30 at the opposed end will allow lead insulation means to be fixed to the cabinet 2 in a manner which prevents the user from inadvertently pulling the cabinet 2 away from the leads 11.

Figure 5:
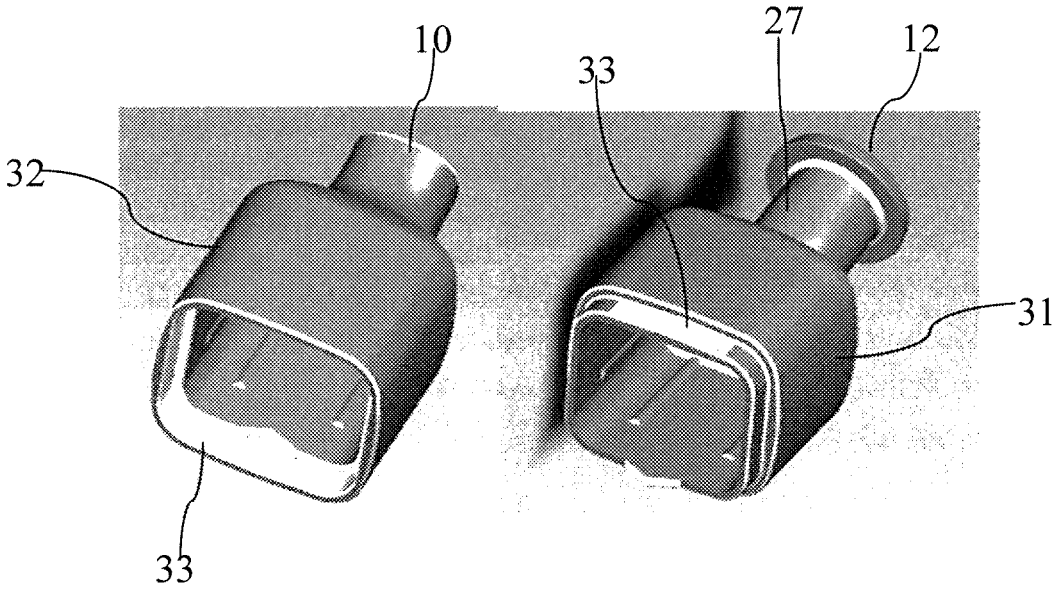
FIG. 5 is a computer-generated graphic representation of the two parts of a speaker cabinet.

As disclosed in FIG. 5 the cabinet comprises two parts, a front part 31 with the snout 27 and sound exit opening 12 and, a rear part 32 comprising the lead input opening 10. The two parts are glued together along glue lines 33 as seen in FIGS. 1, and 3.

Figure 6:
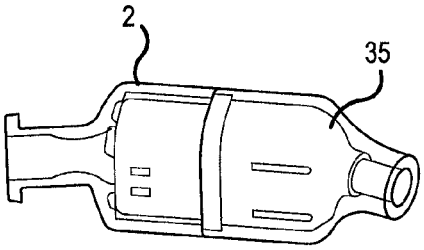
FIG. 6 shows a speaker cabinet with a hole in it for introduction of a hardenable silicone.

A further opening 35 is provided in the rear part 32 as seen in FIG. 6. Through this opening 35 the hardening silicone may be dispensed to fill out the gap 13 between the speaker capsule 3 and the inner walls of the cabinet 2.

When a hearing aid of the above kind is to be produced, a hearing aid speaker unit comprising an oblong speaker capsule 3 is enclosed in a cabinet 2, in that a first cabinet part 31 and a second cabinet part 32 are initially assembled to form an enclosure with the speaker capsule 3 inside it. In doing this, the speaker capsule 3 is seated in the cabinet 2 with opposed gaps 13 of equal size at least in a plane having a normal along the length-axis of the oblong capsule 3. At last, following assembly of the cabinet parts 31,32 a fluid silicone dampening medium is introduced to fill out the gap 13.

Figure 7A:
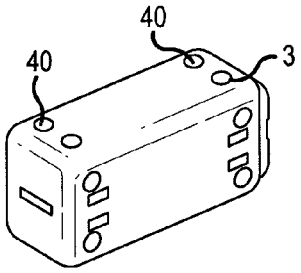
FIGS. 7A-7D show examples of measure to ensure centered positioning of the speaker capsule within the cabinet.
Figure 7B:
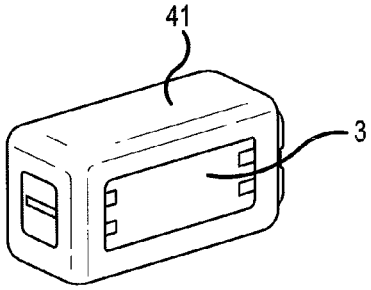
Figure 7C:
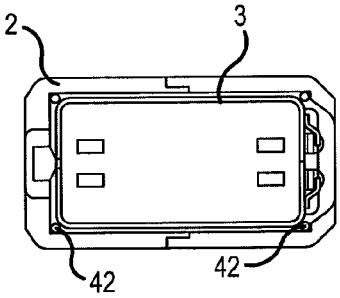
Figure 7D:
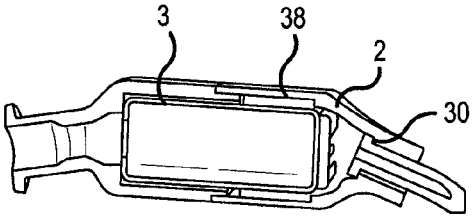

In FIG. 7D the speaker capsule comprises pads of soft flexible foam 38 enabling an equal distance to any internal wall part of the cabinet 2. In ensuring the equal size of the opposed gaps 13, a speaker capsule 3 having a square or rectangular shape in the mentioned plane is chosen as also seen from FIG. 7D, and flexible distance cushions 38 are initially attached to all four sides of the square or rectangular capsule 3. An adhesive may be used for this attachment.

In FIG. 7A flexible bumps 40 are initially applied to surface parts of each of the four sides of the rectangular capsule 3. When inserted into the cabinet, the bumps will keep the capsule 3 well aligned.

In FIG. 7B a flexible mesh 41 is shown on the speaker capsule 3, which is initially attached to at least all four sides of the speaker capsule 3. In the disclosed example it is a mesh comprising a soft silicone sheath with some parts covering the speaker capsule 3 and with openings in the sheath to expose other parts of the capsule. The mesh could be made very fine with densely set open and covered parts of the capsule.

In FIG. 7C o-rings 42 are shown at the two ends of the capsule 3, which are initially attached either externally the speaker capsule 3 or internally to the two parts of the cabinet 2. Such o-rings 42 will ensure that the capsule 3 is placed with equal distance between the external wall parts of the capsule 3 and opposed internal wall parts of the cabinet 2.

The invention claimed is:

1. A miniature speaker and speaker cabinet assembly, comprising:

a speaker enclosed in a capsule of oblong shape with a sound output opening at one end of the capsule and leads passing from a speaker coil inside the capsule to connection points externally on the capsule;

a cabinet enclosing the capsule, the cabinet including at one end thereof a lead input opening with leads passing through the lead opening to the connection points on the capsule, and a sound exit opening opposite the lead input opening, which is in fluid communication with the sound output opening of the capsule, wherein the cabinet has an internal space surpassing external measures of the capsule in all directions defining a gap between an exterior surface of the capsule and an inner surface of the cabinet, the exterior surface of the capsule includes soft pads fastened to the capsule, the soft pads center the capsule within the cabinet at least in a plane defined by a normal parallel to a center axis along the length of the capsule when the capsule is positioned inside the internal space of the cabinet, the sound output opening of the capsule is surrounded by a gasket forming a seal between the inner surface of the cabinet and the sound opening, and the gap between the exterior surface of the capsule and the inner surface of the cabinet is filled with a hardening silicone.

2. A hearing aid, comprising:

a casing part including an audio signal input device, a battery, a signal processor, and output contact points for serving an enhanced audio output signal, leads with a contact attachable to the output contact points at one end and at the other end thereof a miniature speaker and a speaker cabinet, wherein the speaker is enclosed in a capsule of oblong shape with a sound output opening at one end of the capsule and leads passing from a speaker coil inside the capsule to connection points externally on the capsule, the cabinet encloses the capsule, the cabinet including at one end thereof a lead input opening with leads passing through the lead opening to the connection points on the capsule, and a sound exit opening opposite the lead input opening, which is in fluid communication with the sound output opening of the capsule, wherein the cabinet has an internal space surpassing external measures of the capsule in all directions, defining a gap between an inner surface of the cabinet and an exterior surface of the capsule, the exterior surface of the capsule includes soft pads fastened to the capsule, the soft pads center the capsule within the cabinet at least in a plane defined by a normal parallel to a center axis along the length of the capsule when the capsule is positioned inside the internal space of the cabinet, the sound output opening of the capsule is surrounded by a gasket forming a seal between the inner surface of the cabinet and the sound opening, and the gap between the exterior surface of the capsule and the inner surface of the cabinet is filled with a hardening silicone.

3. Hearing aid as claimed in claim 2, wherein the cabinet enclosing the speaker capsule comprises a snout defining the sound exit opening at a first end thereof with a flange surrounding the sound exit opening, and where the lead input opening at an opposed end thereof comprise an internal recess.

4. Hearing aid as claimed in claim 3, wherein the cabinet is an assembly of a front part comprising the snout and sound exit opening and a rear part comprising the lead input opening, whereby the front part and rear part are glued to each other to form the casing.

5. Hearing aid as claimed in claim 4, wherein a further opening is provided in the rear part wherethrough the hardening silicone may be dispensed to fill out the gap between the speaker capsule and the inner walls of the cabinet.

6. Hearing aid as claimed in claim 4, wherein the soft pads include soft flexible foam enabling an equal distance to any internal wall of the cabinet.

7. A method for producing a hearing aid speaker unit, comprising:

providing a speaker capsule of oblong shape holding a speaker coil, the capsule including a sound output opening at one end of the capsule and leads passing from the speaker coil inside the capsule to connection points externally on the capsule;

enclosing the capsule in a cabinet, the enclosing including inserting the capsule into a first cabinet part;

placing a second cabinet part onto a portion of the capsule protruding from the first cabinet part;

assembling the first and second cabinet parts to form an enclosure with the speaker capsule inside it, wherein the speaker capsule at least in a plane having a normal along the oblong axis of the capsule is seated in the cabinet with opposed gaps of equal size; and following said assembling, injecting a fluid silicone dampening medium through a hole in the cabinet to fill out the gap between the capsule and the cabinet.

8. The method as claimed in claim 7, wherein the speaker capsule has a square or rectangular shape in said plane, and flexible distance cushions are attached to four sides of the rectangular capsule prior to said inserting.

9. The method as claimed in claim 8, further comprising:

attaching one square cushion on each side to the speaker capsule.

10. The method as claimed in claim 7, further comprising:

applying flexible bumps to surface parts of each of the four sides of the rectangular capsule.

11. The method as claimed in claim 7, further comprising:

attaching a flexible mesh to at least all four sides of the speaker capsule.

12. The method as claimed in claim 7, further comprising:

attaching o-rings either externally to the speaker capsule or internally to the two parts of the cabinet.

13. The miniature speaker and speaker cabinet assembly according to claim 1, further comprising:

elongate ribs formed on the inner surface of the cabinet and extending parallel to the center axis.

14. The hearing aid according to claim 2, wherein the audio signal input device is one of a microphone and an antenna.

15. The hearing aid according to claim 2, wherein the cabinet includes elongate ribs formed on the inner surface of the cabinet and extending parallel to the center axis.

16. The method according to claim 7, further comprising: centering the capsule within the first cabinet part at least in a plane defined by a normal parallel to a center axis along the length of the capsule during said inserting.

* * * * *